US008944761B2

(12) United States Patent
Farineau et al.

(10) Patent No.: US 8,944,761 B2
(45) Date of Patent: Feb. 3, 2015

(54) WELDED ROTOR, A STEAM TURBINE HAVING A WELDED ROTOR AND A METHOD FOR PRODUCING A WELDED ROTOR

(75) Inventors: Thomas Joseph Farineau, Schoharie, NY (US); Robert G. Baran, Clifton Park, NY (US); Manuel Julio Gomez Fernandez, Ribadavia (ES)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 13/011,090

(22) Filed: Jan. 21, 2011

(65) Prior Publication Data

US 2012/0189461 A1 Jul. 26, 2012

(51) Int. Cl.

| | |
|---|---|
| ***F04D 29/04*** | (2006.01) |
| ***F01D 5/02*** | (2006.01) |
| ***F01D 5/06*** | (2006.01) |
| ***F01D 5/28*** | (2006.01) |

(52) U.S. Cl.

CPC ..... *F01D 5/026* (2013.01); *F01D 5/063* (2013.01); *F01D 5/28* (2013.01); *F05B 2220/25* (2013.01); *F05D 2220/31* (2013.01)

USPC ..... 415/216.1

(58) Field of Classification Search

CPC ..... F05D 2300/13; F05D 2300/131; F05D 2300/132; F05D 2300/177; F01D 5/06; F01D 5/063; F01D 5/066

USPC ..... 415/199.5, 216.1; 416/213 R, 244 R

See application file for complete search history.

(56) References Cited

U.S. PATENT DOCUMENTS

| | | | | |
|---|---|---|---|---|
| 2,103,274 | A * | 12/1937 | Sanford | 60/706 |
| 3,607,238 | A * | 9/1971 | Ridal et al. | 420/109 |
| 6,152,697 | A * | 11/2000 | Konishi et al. | 416/213 R |
| 6,332,754 | B1 * | 12/2001 | Matsuda et al. | 415/191 |
| 6,358,004 | B1 * | 3/2002 | Shiga et al. | 415/200 |
| 6,368,057 | B1 * | 4/2002 | Takahashi et al. | 415/199.5 |
| 6,454,531 | B1 | 9/2002 | Crawmer | |
| 6,499,946 | B1 * | 12/2002 | Yamada et al. | 415/199.4 |
| 6,749,518 | B2 | 6/2004 | Carrier et al. | |
| 7,771,166 | B2 | 8/2010 | Heine et al. | |
| 7,850,423 | B2 * | 12/2010 | Yamashita | 415/199.1 |
| 2007/0253812 | A1 * | 11/2007 | Yamashita | 415/200 |
| 2011/0206525 | A1 | 8/2011 | Shige et al. | |

FOREIGN PATENT DOCUMENTS

| | | | |
|---|---|---|---|
| EP | 1033478 | A2 | 9/2000 |
| EP | 2180147 | A1 * | 4/2010 |
| EP | 2180147 | A2 * | 4/2010 |
| JP | 4288304 | B1 | 4/2010 |

OTHER PUBLICATIONS

Search Report and Written Opinion from corresponding EP Application No. 12151842.7-1267 dated May 10, 2012.

* cited by examiner

*Primary Examiner* — Edward Look
*Assistant Examiner* — Michael Sehn
(74) *Attorney, Agent, or Firm* — McNees Wallace & Nurick LLC

(57) ABSTRACT

A welded rotor, a steam turbine having a welded rotor, and a method of producing a welded rotor are disclosed. The welded rotor includes a high pressure section and an intermediate pressure section. The high pressure section includes a high temperature material section joined to a low temperature material section.

20 Claims, 3 Drawing Sheets

WELDED ROTOR, A STEAM TURBINE HAVING A WELDED ROTOR AND A METHOD FOR PRODUCING A WELDED ROTOR

FIELD OF THE INVENTION

The present invention is generally directed to steam turbines, and more specifically directed to a steam turbine having a welded rotor shaft.

BACKGROUND OF THE INVENTION

A typical steam turbine plant may be equipped with a high pressure steam turbine, an intermediate pressure steam turbine and a low pressure steam turbine. Each steam turbine is formed of materials appropriate to withstand operating conditions (pressure, temperature, flow rate, etc.) for that particular turbine.

Recently, steam turbine plant designs directed toward a larger capacity and a higher efficiency have been designed that include steam turbines that operate over a range of pressures and temperatures. The designs have included high-low pressure integrated, high-intermediate-low pressure integrated, and intermediate-low pressure integrated steam turbine rotors integrated into one piece and using the same metal material for each steam turbine. Often, a metal is used that is capable of performing in the highest of operating conditions for that turbine, thereby increasing the overall cost of the turbine.

A steam turbine conventionally includes a rotor and a casing jacket. The rotor includes a rotatably mounted turbine shaft that includes blades. When heated and pressurized steam flows through the flow space between the casing jacket and the rotor, the turbine shaft is set in rotation as energy is transferred from the steam to the rotor. The rotor, and in particular the rotor shaft, often forms of the bulk of the metal of the turbine. Thus, the metal that forms the rotor significantly contributes to the cost of the turbine. If the rotor is formed of a high cost, high temperature metal, the cost is even further increased.

Accordingly, it would be desirable to provide a steam turbine rotor formed of the least amount of high temperature materials.

SUMMARY OF THE INVENTION

According to an exemplary embodiment of the present disclosure, a rotor is disclosed that includes a high pressure section having a first end and a second end, and an intermediate pressure section joined to the second end of the high pressure section. The high pressure section includes a high temperature material section formed of a high temperature material. The high pressure section having a first end and a second end opposite thereof. A first low temperature material section formed of a first low temperature material is joined to the first end of the high temperature material section, and a second low temperature material section formed of a second low temperature material is joined to the second end of the high temperature material.

According to another exemplary embodiment of the present disclosure, a steam turbine is disclosed that includes a rotor. The rotor includes a high pressure section having a first end and a second end, and an intermediate pressure section joined to the second end of the high pressure section. The high pressure section includes a high temperature material section formed of a high temperature material and having a first end and a second end opposite thereof, and a first low temperature material section formed of a first low temperature material joined to the first end of the high temperature material section, and a second low temperature material section formed of a second low temperature material joined to the second end of the high temperature material section.

According to another exemplary embodiment of the present disclosure, a method of manufacturing a rotor is disclosed that includes providing a shaft high pressure section, and joining a shaft intermediate pressure section to the shaft high pressure section. The shaft high pressure section includes a first end and a second end, and a first low temperature material section is joined to the first end of the high temperature material section, and a second low temperature material section is joined to the second end of the high temperature material section.

One advantage of an embodiment of the present disclosure includes providing a lower cost steam turbine rotor.

Another advantage of an embodiment of the present disclosure includes providing a lower cost steam turbine rotor that has a reduced amount of high temperature material.

Another advantage of an embodiment of the present disclosure includes providing a lower cost steam turbine.

Another advantage of an embodiment of the present disclosure includes providing a lower cost steam turbine that has a reduced amount of high temperature material.

Another advantage of an embodiment of the present disclosure includes providing a lower cost steam turbine rotor that uses a reduced amount of high temperature material that may not be available in large volumes.

Another advantage of an embodiment of the present disclosure includes providing a lower cost steam turbine rotor that uses smaller ingots of high temperature materials for manufacture.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

The present disclosure now will be described more fully hereinafter with reference to the accompanying drawings, in which an exemplary embodiment of the disclosure is shown. This disclosure may, however, be embodied in many different forms and should not be construed as limited to the embodiments set forth herein.

Figure 1:
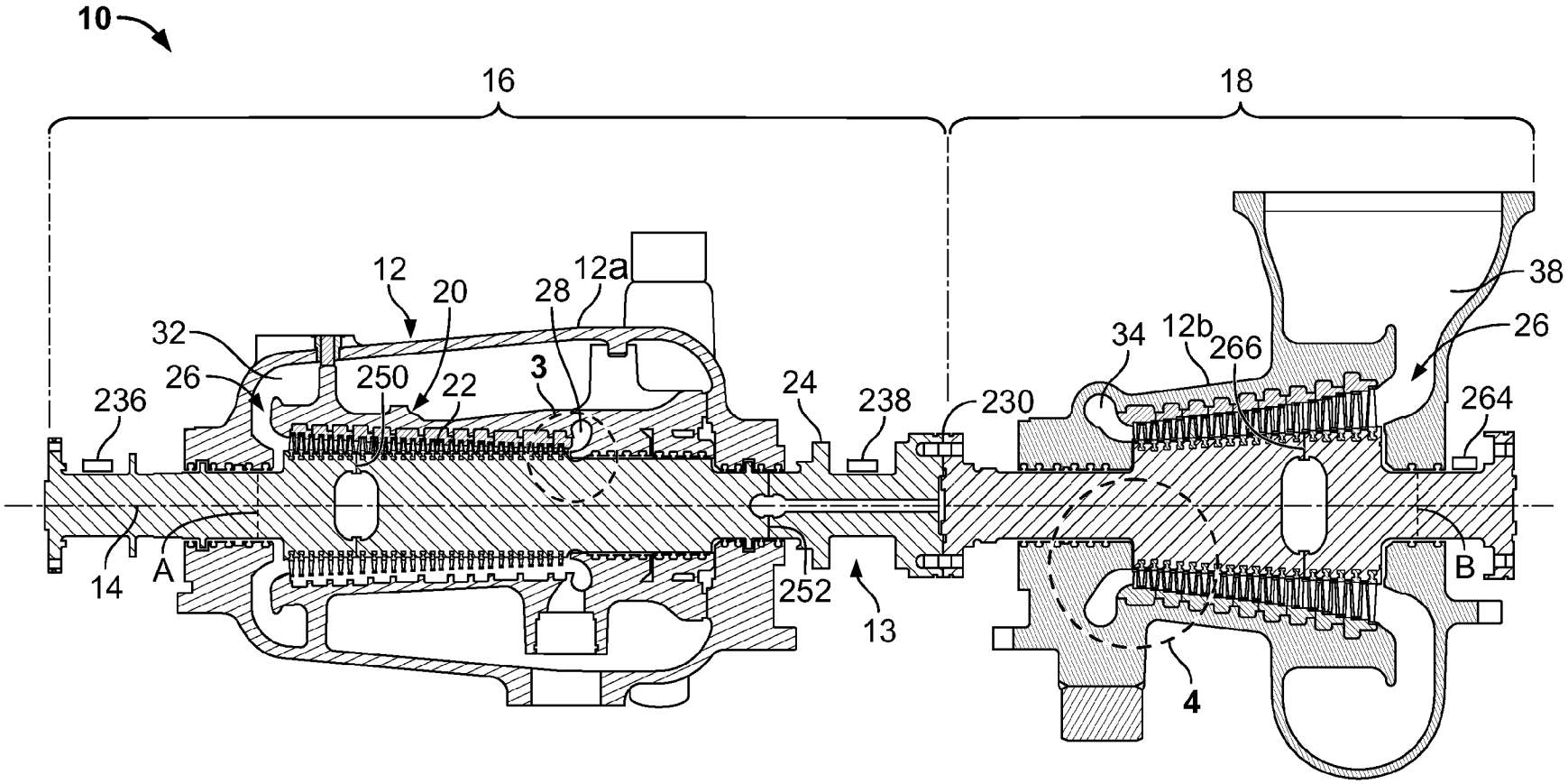
FIG. 1 is a sectional view of a steam turbine according to the present disclosure
Figure 3:
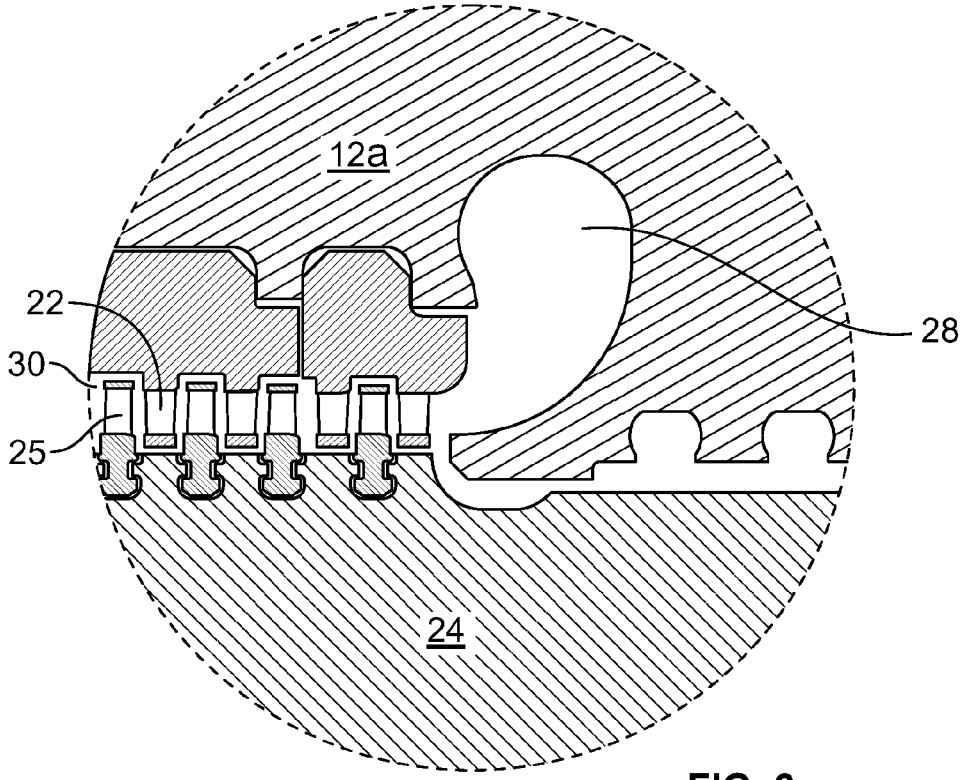
FIG. 3 is a partial cross-sectional view of a portion of the steam turbine of FIG. 1.
Figure 4:
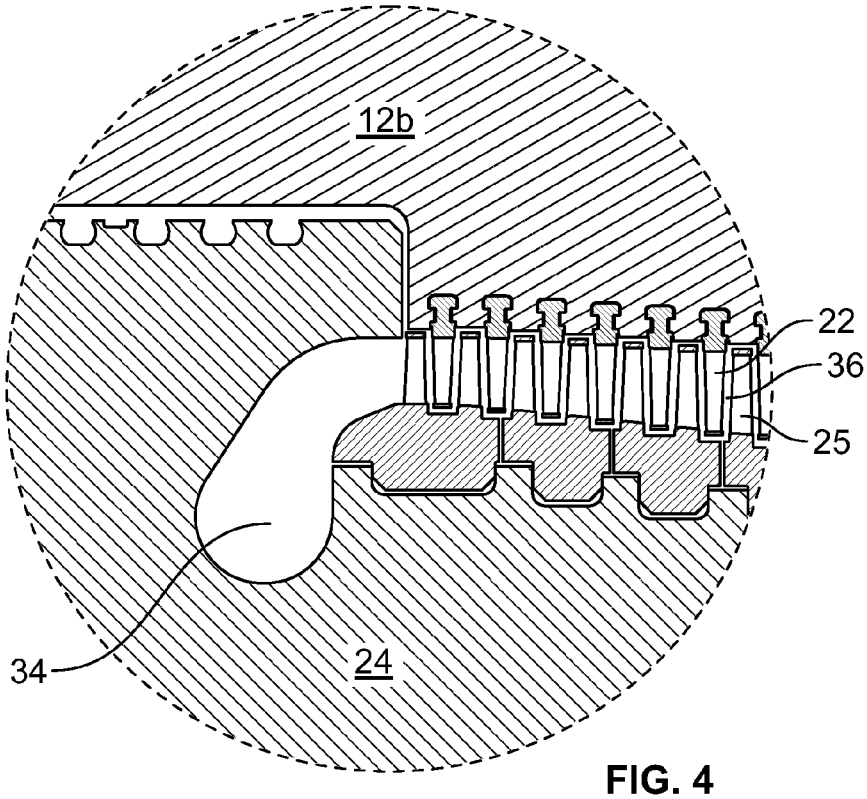
FIG. 4 is another partial cross-sectional view of a portion of the steam turbine of FIG. 1.

FIGS. 1, 3, 4 illustrate a sectional diagram of a steam turbine 10 according to an embodiment of the disclosure. The steam turbine 10 includes a casing 12 in which a turbine rotor 13 is mounted rotatably about an axis of rotation 14. The steam turbine 10 further includes a turbine high pressure (HP) section 16 and a turbine intermediate pressure (IP) section 18.

The steam turbine 10 operates at sub-critical operating conditions. In one embodiment the steam turbine 10 receives steam at a pressure below about 230 bar. In another embodiment, the steam turbine 10 receives steam at a pressure between about 100 bar to about 230 bar. In another embodiment, the steam turbine 10 receives steam at a pressure between about 125 bar to about 175 bar. Additionally, the steam turbine 10 receives steam at a temperature between about 525° C. and about 600° C. In another embodiment, the steam turbine 10 receives steam at a temperature between about 565° C. and about 600° C.

The casing 12 includes an HP casing 12*a* and an IP casing 12*b*. In another embodiment, the casing 12 may be a single, integrated HP/IP casing. In this exemplary embodiment, the casing 12 is a double-wall casing. In another embodiment, the casing may be a single-wall casing. The casing 12 includes a housing 20 and a plurality of guide vanes 22 attached to the housing 20. The rotor 13 includes a shaft 24 and a plurality of blades 25 fixed to the shaft 24. The shaft 24 is rotatably supported by a first bearing 236, a second bearing 238, and third bearing 264.

A main steam flow path 26 is defined between the casing 12 and the rotor 13. The main steam flow path 26 includes a HP main steam flow path 30 located in the turbine HP section 16 and a IP main steam flow path 36 located in the turbine IP section 18. As used herein, the term "main steam flow path" means the primary flow path of steam that produces power.

Steam is provided to an HP inflow region 28 of the main steam flow path 26. The steam flows through the HP main steam flow path section 30 of the main steam flow path 26 between vanes 22 and blades 25, during which the steam expands and cools. Thermal energy of the steam is converted into mechanical, rotational energy as the steam rotates the rotor 13 about the axis 14. After flowing through the HP main steam flow path section 30, the steam flows out of an HP steam outflow region 32 into an intermediate superheater (not shown), where the steam is heated to a higher temperature. The steam is introduced via lines (not shown) to a IP main steam inflow region 34. The steam flows through an IP main steam flow path section 36 of the main steam flow path 26 between vanes 22 and blades 25, during which the steam expands and cools. Additional thermal energy of the steam is converted into mechanical, rotational energy as the steam rotates the rotor 13 about the axis 14. After flowing through the IP main steam flow path section 36, the steam flows out of an IP steam outflow region 38 out of the steam turbine 10. The steam may be used in other operations, not illustrated in any more detail.

Figure 2:
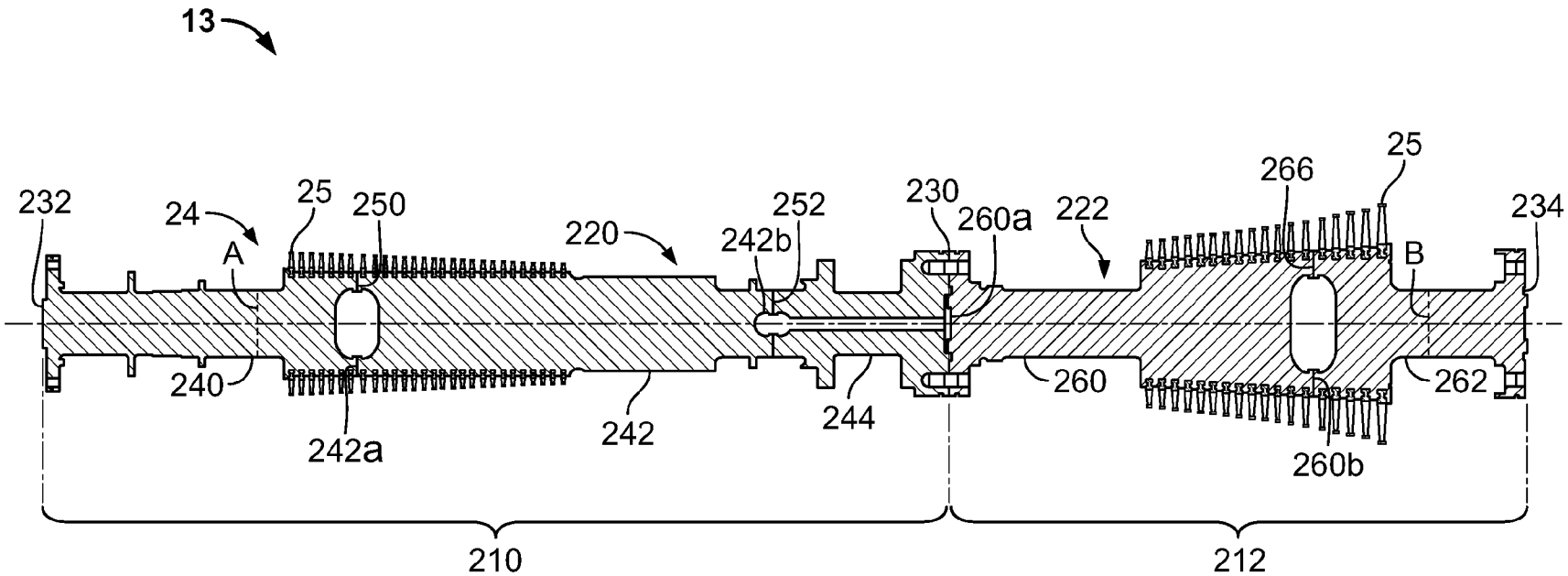
FIG. 2 is a cross-sectional view of an embodiment of the steam turbine rotor of FIG. 1.

FIG. 2 illustrates a sectional view of the rotor 13. Rotor 13 includes a shaft 24. As can be seen in FIG. 2, rotor 13 includes a rotor HP section 210 located in the turbine HP section 16 (FIG. 1) and a rotor IP section 212 located in the turbine IP section 18 (FIG. 1). Correspondingly, the shaft 24 includes a shaft HP section 220 located in the turbine HP section 16 and a shaft IP section 222 located in the turbine IP section 18. The shaft HP and IP sections 220, 222 are joined at a bolted joint 230. In another embodiment, the shaft HP and IP sections 220, 222 are joined by welding, bolting, or other joining technique.

The shaft HP section 220 may be joined to another component (not shown) at the first end 232 of the shaft 24 by a bolted joint, a weld, or other joining technique. In another embodiment, the shaft HP section 220 may be bolted to a generator at the first end 232 of shaft 24. The shaft IP section 222 may be joined to another component (not shown) at a second end 234 of the shaft 24 by a bolted joint, a weld, or other joining technique. In another embodiment, the shaft IP section 222 may be joined to a low pressure section at the second end 234 of shaft 24. In another embodiment, the low pressure section may include a low pressure turbine.

The shaft HP section 220 receives steam at a pressure below 230 bar. In another embodiment, the shaft HP section 220 may receive steam at a pressure between about 100 bar to about 230 bar. In another embodiment, the shaft HP section 220 may receive steam at a pressure between about 125 bar to about 175 bar. The shaft HP section 220 receives steam at a temperature of between about 525° C. and about 600° C. In another embodiment, the shaft HP section 220 may receive steam at a temperature between about 565° C. and about 600° C.

The shaft HP section 220 includes a first HP low temperature material (LTM) section 240, a HP high temperature material (HTM) section 242, and an second HP LTM section 244. In another embodiment, the second HP LTM section 244 is deleted, and the HP HTM section 242 extends to the bolted joint 230.

The shaft HP section 220 is rotatably supported by a first bearing 236 (FIG. 1) and a second bearing 238 (FIG. 1). In an embodiment, the first bearing 236 may be a journal bearing. In an embodiment, the second bearing 238 may be a thrust/journal bearing. The first bearing 236 supports the first HP LTM section 240, and the second bearing 238 supports the second HP LTM section 244. In an embodiment where the HP HTM section 242 extends to the bolted joint 230, the second bearing 238 supports the HP HTM section 242. In another embodiment, different support bearing configurations may be used.

The first and second HP LTM sections 240, 244 are joined to the HP HTM section 242 by a first and a second welds 250, 252, respectively. In this exemplary embodiment, the first weld 250 is located along the HP main steam flow path 30 (FIG. 1) and the second weld 252 is located outside or not in contact with the HP main steam flow path 30. In an embodiment, the first weld 250 may be located along the HP main steam flow path 30 where the steam temperature is less than about 455° C. In another embodiment, the first weld 250 may be located outside or not in contact with the HP steam flow path 30. In an embodiment, the first weld 250 may be located at position "A" (FIG. 1) outside and not in contact with the HP steam flow path 30, but may be in contact with seal steam leakage.

The HP HTM section 242 at least partially defines the HP inflow region 28 and HP main steam flow path 30 (FIG. 3). The first HP LTM section 240 further at least partially defines the HP main steam main flow path 30. As discussed above, in another embodiment, the first weld 250 may be moved so that the first HP LTM section 240 does not at least partially define the HP main steam flow path 30. The second HP LTM section 244 does not at least partially define the main steam flow path 26, or in other words, the second LTM section 244 is outside of the HP main steam flow path 30 and does not contact the main steam flow path 26.

The HP HTM section 242 of the shaft 24 is formed of a single, unitary section or block of high temperature resistant material. The high temperature resistant material may be referred to as a high temperature material. The HP HTM section 242 has a first end 242*a* and a second end 242*b*. In another embodiment, the HP HTM section 242 may be formed of two or more HP HTM sections or blocks of high temperature material that are joined together by a material joining technique, such as, but not limited to welding.

The high temperature material may be a forging steel. In an embodiment, the high temperature material may be a steel including an amount of chromium (Cr), molybdenum (Mo), vanadium (V), and nickel (Ni). In an embodiment, the high temperature material may be a high chromium alloy forged steel including Cr in an amount between about 10.0 weight percent (wt. %) to about 13.0 wt. %. In another embodiment, the amount of Cr may be included in an amount between about 10.0 wt. % and about 10.6 wt. %. In an embodiment, the high chromium alloy forged steel may have Mo in an amount between about 0.5 wt. % and about 2.0 wt. %. In another embodiment, the amount of Mo may be included in an amount of between about 1.0 wt. % and about 1.2 wt. %. In an embodiment, the high chromium alloy forged steel may include V in an amount between about 0.1 wt. % and about 0.3 wt. %. In another embodiment, the V may be included in amount between about 0.15 wt. % and about 0.25 wt. %. In an embodiment, the high chromium alloy forged steel may include Ni in an amount between about 0.5 wt. % to about 1.0 wt. %. In another embodiment, the Ni may be included in an amount between about 0.6 wt. % and about 0.8 wt. %.

The first and second HP LTM sections 240, 244 are formed of a less heat resistant material than the high temperature material forming the HP HTM section 242. The less heat resistant material may be referred to as a low temperature material. The low temperature material may be a forged alloy steel. In an embodiment, the low temperature material may be a CrMoVNi. In an embodiment, Cr may be included in an amount between about 0.5 wt. % and about 2.2 wt. %. In another embodiment, Cr may be included in an amount between about 0.5 wt. % and about 2.0 wt. %. In another embodiment, Cr may be included in an amount between about 0.9 wt. % and about 1.3 wt. %. In an embodiment, Mo may be included in an amount between about 0.5 wt. % and about 2.0 wt. %. In another embodiment, Mo may be included in an amount between about 1.0 wt. % and about 1.5 wt. %. In an embodiment, V may be included in an amount between about 0.1 wt. % and about 0.5 wt. %. In another embodiment, V may be included in an amount of between about 0.2 wt. % and about 0.3 wt. %. In an embodiment, Ni may be included in an amount between about 0.2 wt. % to about 1.0 wt. %. In another embodiment, Ni may be included in an amount between about 0.3 wt. % and about 0.6 wt. %.

In an embodiment, the first and second HP LTM sections 240, 244 are formed of the same low temperature material. In another embodiment, the first and second HP LTM sections 240, 244 are formed of different low temperature materials. In this embodiment, the first and second HP LTM sections 240, 244 are formed of a single, unitary block or section of low temperature material. In another embodiment, one or both of the first and second HP LTM sections 240, 244 may be formed of two or more HP LTM sections or blocks that are joined together. The two or more HP LTM sections or blocks may be mechanically or materially joined together, for example, such as, but not limited to bolting or welding.

The shaft IP section 222 is rotatably supported by a bearing 264 (FIG. 1). In an embodiment, the bearing 264 may be a journal bearing. In another embodiment, the shaft IP section 222 may be rotatably supported by one or more bearings. The shaft IP section 222 receives steam at a pressure below about 70 bar. In another embodiment, the shaft IP section 222 may receive steam at a pressure of between about 20 bar to 70 bar. In yet another embodiment, the shaft IP section 222 may receive steam at a pressure of between about 20 bar to about 40 bar. Additionally, the shaft IP section 222 receives steam at a temperature of between about 525° C. and about 600° C. In another embodiment, the shaft IP section 222 may receive steam at a temperatures of between about 565° C. and about 600° C.

The shaft IP section 222 includes an IP HTM section 260 and an IP LTM section 262. The shaft IP HTM and LTM sections 260, 262 are joined by a third weld 266. The third weld 266 is located along the IP steam flow path 36. In an embodiment, the third weld 266 may be located along the IP steam flow path 36 where the steam temperature is less than 455° C. In another embodiment, the third weld 266 may be located outside or not in contact with the IP steam flow path 36. For example, the third weld 266 may be located at position "B" (FIG. 1) located outside and not in contact with the IP steam flow path 36. In another embodiment, the shaft IP section 222 may be formed of one or more IP HTM sections. In another embodiment, the IP section 222 may be formed of a single, unitary block or section of high temperature material.

Referring again to FIG. 1, the IP IITM section 260 at least partially defines the IP steam inflow region 34 and IP main steam flow path 36. The IP LTM section 262 further at least partially defines the IP main steam flow path 36. In another embodiment, the third weld 266 may be moved, for example to position "B", so that the IP LTM section 262 does not at least partially define the IP main steam flow path 36 or in other words, the IP LTM section 262 is outside of the IP main steam flow path 36 and does not contact the main flow path of steam.

Referring again to FIG. 2, the IP HTM section 260 is formed of a high temperature material. The high temperature material may be the high temperature material as discussed above in reference to the HP HTM section 242. In this embodiment, the IP HTM section 260 is formed of a single, unitary high temperature material section or block having a first end 260*a* and a second end 260*b*. In another embodiment, the IP HTM section 260 may be formed of two or more IP HTM sections welded together.

The IP LTM section 262 is formed of a less heat resistant material than the IP HTM section 260. The less heat resistant material section may be referred to as a low temperature material. The low temperature material may be a low temperature material as discussed above in reference to the first and second HP LTM sections 240, 244. In this embodiment, the IP LTM section 262 is formed of a single, unitary section or block of low temperature material. In another embodiment, the IP LTM section 262 may be formed of two or more IP LTM sections that are joined together. The two or more IP LTM sections may be mechanically or materially joined together, for example, such as, but not limited to bolting or welding. In another embodiment, the shaft IP section 222 may be formed of one or more HTM sections, without the use of a L™ section. In an embodiment where two or more HTM sections are used to form the shaft IP section 222, the two or more HTM sections may be joined by bolting, welding or other metal joining technique The shaft 24 may be produced by an embodiment of a method of manufacturing as described below. The shaft HP section 220 may be produced by providing a block or section of a high temperature material that forms an HP HTM section 242 having a first end 242*a* and a second end 242*b*. A first HP LTM section 240 formed of a block of a low temperature material is welded to the first end 242*a* of the HP HTM section 242. A second LTM section 244 formed of a block of a low temperature material is welded to the second end 242*b* of the HP HTM section 242 to form the shaft HP section 220. In another embodiment, the shaft 24 may be produced by providing one or more blocks or sections of a high temperature material that forms a HP HTM section 242 having a first end 242*a* and a second end 242*b*. A first HP LTM section 240 formed of one or more blocks of low temperature material is welded to the first end 242*a* of the HP HTM section 242. A second LTM section 244 formed of one or more blocks of low temperature material is welded to the second end 242*b* of the HP HTM section 242 to form the shaft HP section 220.

The shaft IP section 222 may be produced by providing a block of a high temperature resistant material that forms an IP HTM section 260 having a first end 260*a* and a second end 260*b*. An IP LTM section 262 formed of one a low temperature material is welded to the first end 260*a* to form the shaft IP section 222. In another embodiment, a shaft IP section 222 may be produced by providing one or more blocks of high temperature resistant material that forms an IP HTM section 260 having a first end 260*a* and a second end 260*b*. An IP LTM section 262 formed of one or more sections of low temperature material is welded to the first end 260*a* to form the shaft IP section 222.

The shaft 24 is produced by joining the shaft HP section 220 to the shaft IP section 222. The shaft HP section 220 is joined to the shaft IP section 222 by bolting the second LTM section 244 of the shaft HP section 220 to the IP HTM section 260. In another embodiment, the shaft HP section 220 may be joined to the shaft IP section 222 by bolting, welding or other metal joining technique.

While only certain features and embodiments of the invention have been shown and described, many modifications and changes may occur to those skilled in the art (for example, variations in sizes, dimensions, structures, shapes and proportions of the various elements, values of parameters (for example, temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A rotor, comprising:

a high pressure section having a first end and a second end and a high pressure casing, the second end extending beyond the high pressure casing; and an intermediate pressure section mechanically joined at a shaft of the rotor to the second end of the high pressure section, the intermediate pressure section having an intermediate pressure casing;

wherein the high pressure section comprises a high temperature material section formed of a high temperature material, and having a first end and a second end opposite thereof;

a first low temperature material section formed of a first low temperature material, the first low temperature material section joined to the first end of the high temperature material section at a first joint; and a second low temperature material section formed of a second low temperature material, the second low temperature material section joined to the second end of the high temperature material at a second joint, the second joint being within the high pressure section;

wherein the first joint is located within the high pressure section on the rotor at a position along a high pressure main steam flow path at or adjacent a blade secured to the rotor.

2. The rotor of claim 1, wherein the intermediate pressure section is mechanically joined to the second end of the high pressure section by bolting the intermediate pressure section to the second low temperature material section.

3. The rotor of claim 1, wherein the intermediate pressure section includes an intermediate pressure high temperature material section and an intermediate pressure low temperature material section.

4. The rotor of claim 1, wherein the first low temperature material section at least partially defines the high pressure main steam flow path.

5. The rotor of claim 1, wherein the high temperature material is a chromium alloy forged steel.

6. The rotor of claim 1, wherein the first and second low temperature materials comprise a forged alloy steel.

7. The rotor of claim 5, wherein the chromium alloy forged steel comprises:

about 10.0 wt. % to about 13.0 wt. % Cr;

about 0.5 wt. % to about 2.0 wt. % Mo;

about 0.1 wt. % to about 0.3 wt. % V; and about 0.5 wt. % to about 1.0 wt. % Ni.

8. The rotor of claim 6, wherein the forged alloy steel comprises:

about 0.5 wt. % to about 2.2 wt. % Cr;

about 0.5 wt. % to about 2.0 wt. % Mo;

about 0.1 wt. % to about 0.5 wt. % V; and about 0.2 wt. % to about 1.0 wt. % Ni.

9. A steam turbine, comprising:

a rotor, comprising:

a high pressure section having a first end and a second end and a high pressure casing, the second end extending beyond the high pressure casing; and an intermediate pressure section mechanically joined at a shaft of the rotor to the second end of the high pressure section, the intermediate pressure section having an intermediate pressure casing;

wherein the high pressure section comprises a high temperature material section formed of a high temperature material, and having a first end and a second end opposite thereof;

a first low temperature material section formed of a first low temperature material, the first low temperature material section joined to the first end of the high temperature material section at a first joint; and a second low temperature material section formed of a second low temperature material, the second low material section joined to the second end of the high temperature material at a second joint, the second joint being within the high pressure section;

wherein the first joint is located within the high pressure section on the rotor at a position along a high pressure main steam flow path at or adjacent a blade secured to the rotor.

10. The steam turbine of claim 9, wherein the intermediate pressure section includes an intermediate pressure high temperature material section and an intermediate pressure low temperature material section.

11. The steam turbine of claim 9, wherein the intermediate pressure section is mechanically joined to the second end of the high pressure section by bolting the intermediate pressure section to the second low temperature material section.

12. The steam turbine of claim 9, wherein the first low temperature material section at least partially defines the high pressure steam flow path.

13. The steam turbine of claim 9, wherein the high temperature material is a chromium alloy forged steel.

14. The steam turbine of claim 9, wherein the first and second low temperature materials are a forged alloy steel.

15. The steam turbine of claim 12, wherein the chromium alloy forged steel comprises:

about 10.0 wt. % to about 13.0 wt. % Cr;
about 0.5 wt. % to about 2.0 wt. % Mo;
about 0.1 wt. % to about 0.3 wt. % V; and
about 0.5 wt. % to about 1.0 wt. % Ni.

16. The steam turbine of claim 13, wherein the forged alloy steel comprises:

about 0.5 wt. % to about 2.2 wt. % Cr;
about 0.5 wt. % to about 2.0 wt. % Mo;
about 0.1 wt. % to about 0.5 wt. % V; and
about 0.2 wt. % to about 1.0 wt. % Ni.

17. A method of manufacturing a rotor, comprising:

providing a shaft high pressure section having a high pressure casing; and mechanically joining a shaft intermediate pressure section having an intermediate pressure casing to the shaft high pressure section at a shaft of the rotor extending beyond the high pressure casing;

wherein the shaft high pressure section comprises:

a high temperature material section having a first end and a second end; and a first low temperature material section joined to the first end of the high temperature material section at a first joint; and a second low temperature material section is joined to the second end of the high temperature material section at a second joint, the second joint being within the high pressure section;

wherein the first joint is located within the high pressure section on the rotor at a position along a high pressure main steam flow path at or adjacent a blade secured to the rotor.

18. The method of claim 17, wherein the shaft high pressure section is mechanically joined to the shaft intermediate pressure section by bolting.

19. The method of claim 17, wherein the shaft intermediate pressure section is mechanically joined to the shaft high pressure section by bolting the shaft intermediate pressure section to the second low temperature material section.

20. The method of claim 17, wherein the intermediate pressure section is formed by joining an intermediate pressure high temperature material section and an intermediate pressure low temperature material section.

* * * * *